US007363913B2

(12) United States Patent
Dutt et al.

(10) Patent No.: US 7,363,913 B2
(45) Date of Patent: Apr. 29, 2008

(54) HIGH-PRESSURE PUMP FOR A FUEL INJECTION SYSTEM OF AN INTERNAL COMBUSTION ENGINE

(75) Inventors: Andreas Dutt, Stuttgart (DE); Jochen Aleker, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/593,326

(22) PCT Filed: Jan. 18, 2005

(86) PCT No.: PCT/EP2005/050193

§ 371 (c)(1),
(2), (4) Date: Sep. 18, 2006

(87) PCT Pub. No.: WO2005/090790

PCT Pub. Date: Sep. 29, 2005

(65) Prior Publication Data

US 2007/0215113 A1 Sep. 20, 2007

(30) Foreign Application Priority Data

Mar. 18, 2004 (DE) ..... 10 2004 013 244

(51) Int. Cl.
*F04B 1/04* (2006.01)
*F04B 1/00* (2006.01)

(52) U.S. Cl. ..... 123/450; 123/508

(58) Field of Classification Search ..... 123/450, 123/449, 445, 508; 417/273
See application file for complete search history.

(56) References Cited

U.S. PATENT DOCUMENTS 302,978 A 8/1884 Brislin
1,445,073 A 2/1923 Corpi et al.
4,662,315 A * 5/1987 Sommer ..... 123/23
5,133,645 A * 7/1992 Crowley et al. ..... 417/279
5,230,613 A * 7/1993 Hilsbos et al. ..... 417/439
6,406,272 B2 * 6/2002 Ruthardt et al. ..... 417/273
6,886,536 B2 * 5/2005 Ranaldo et al. ..... 123/456
2002/0009373 A1 1/2002 Ruthhardt et al.

FOREIGN PATENT DOCUMENTS

DE 197 29 790 A1 1/1999
DE 102 21 305 A1 11/2003

* cited by examiner

*Primary Examiner*—Mahmoud Gimie
(74) *Attorney, Agent, or Firm*—Ronald E. Greigg

(57) ABSTRACT

A high-pressure pump has at least one pump element, with a pump piston which is guided displaceably in a cylinder bore of a housing part of the high-pressure pump and is driven in a reciprocating motion and defines a pump work chamber in the cylinder bore, into which chamber fuel is aspirated via an inlet valve in the intake stroke of the pump piston. The inlet valve has a pistonlike valve member, which with a sealing face cooperates with a valve seat for controlling the communication of the pump work chamber with the fuel inlet. The valve member is disposed with a head, on which the sealing face is embodied, in the pump work chamber and protrudes out of the pump work chamber with a shaft adjoining the head. The valve seat is formed in the housing part at a transition from the cylinder bore to a bore of smaller diameter adjoining the cylinder bore. With its shaft, the valve member protrudes through the bore into a region of the housing part remote from the pump work chamber, in which region a closing spring is disposed that engages the shaft of the valve member.

12 Claims, 3 Drawing Sheets

HIGH-PRESSURE PUMP FOR A FUEL INJECTION SYSTEM OF AN INTERNAL COMBUSTION ENGINE

CROSS-REFERENCE TO RELATED APPLICATIONS

This application is a 35 USC 371 application of PCT/EP2005/050193 filed on Jan. 18, 2005.

BACKGROUND OF THE INVENTION

1. Field of the Invention

The invention is directed to an improved high-pressure pump for a fuel injection system of an internal combustion engine.

2. Description of the Prior Art

One high-pressure pump known from German Patent Disclosure 197 29 790 A1 has at least one pump element, with a pump piston guided displaceably in a cylinder bore of a housing part of the high-pressure pump and driven in a reciprocating motion. In the cylinder bore, the pump piston defines a pump work chamber, into which the pump piston, in its intake stroke, aspirates fuel via an inlet valve, and from which the pump piston in its pumping stroke positively displaces fuel. The inlet valve has a pistonlike valve member, which is guided displaceably in a valve housing communicating with the housing part of the high-pressure pump. The valve member has a sealing face, with which it cooperates with a valve seat, embodied on the valve housing for controlling a communication of the pump work chamber with a fuel inlet. The valve member is urged in the closing direction toward the valve seat by a closing spring, disposed in the valve housing, and by the pressure prevailing in the pump work chamber, and is urged in the opening direction by the pressure prevailing in the fuel inlet. The fuel inlet discharges in the valve housing, and the valve housing together with the valve member and the closing spring forms a preassembled structural unit, which is inserted into the housing part of the high-pressure pump. Because of the separate valve housing, the high-pressure pump is complicated and thus expensive to manufacture and produce. Moreover, the valve housing covers the pump work chamber, so that between the housing part of the high-pressure pump and the valve housing, complicated sealing off from the high pressure in the pump work chamber is necessary.

SUMMARY AND ADVANTAGES OF THE INVENTION

The high-pressure pump of the invention has the advantage over the prior art that no separate valve housing for the inlet valve and thus no sealing off from the high pressure in the pump work chamber are necessary. For the housing part, the only additional part that must be made is the valve seat, which can be machined in a simple way from the inside of the cylinder bore. The valve member is introduced from the inside of the cylinder bore, with its shaft leading, and the closing spring is mounted from the outside of the housing part, diametrically opposite the cylinder bore, and joined to the shaft of the valve member.

Advantageous features and refinements of the high-pressure pump of the invention are disclosed. Another version makes an easily manufactured course of the fuel delivery possible. One embodiment enables guidance of the valve member and thus a secure sealing action of the inlet valve as well as low wear to the sealing face and the valve seat possible. A further embodiment, even without guidance of the valve member, makes a secure sealing action of the inlet valve possible.

BRIEF DESCRIPTION OF THE DRAWINGS

Two exemplary embodiments of the invention are described herein below, with reference to the drawings, in which.

DESCRIPTION OF THE PREFERRED EMBODIMENTS

Figure 1:
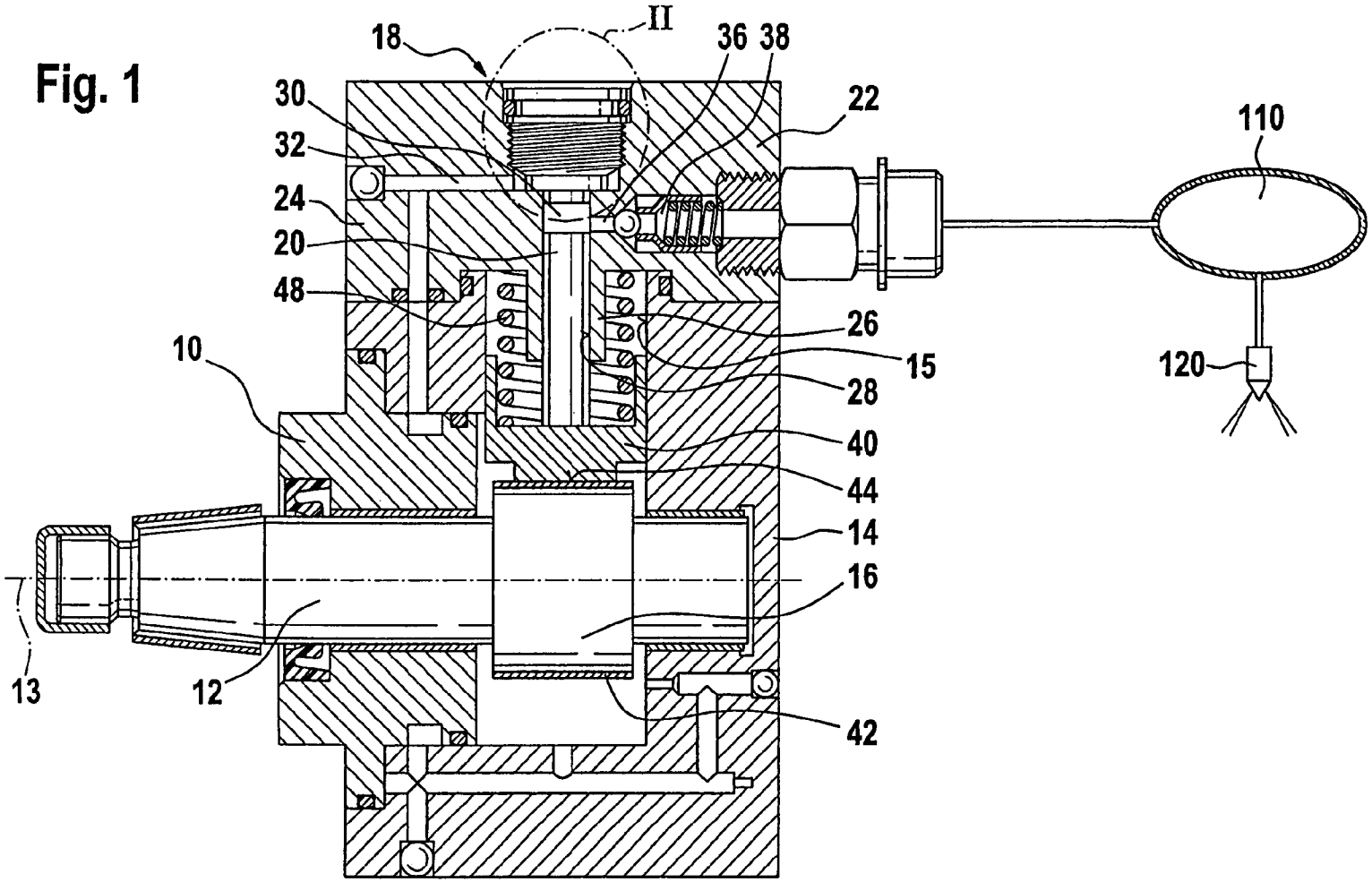
FIG. 1 shows a high-pressure pump for a fuel injection system of an internal combustion engine in a longitudinal section.

In the drawings a high-pressure pump for a fuel injection system of an internal combustion engine is shown which has a multi-part pump housing 10, in which a drive shaft 12, which can be driven to rotate by the engine, is rotatably supported. The drive shaft 12 is rotatably supported in a basic body 14 of the housing 10, via two bearing points spaced apart from one another in the direction of the pivot axis 13 of the drive shaft 12. The basic body 14 of the housing can in turn be embodied in multiple parts, and the bearing points may be located in different parts of the basic body 14. The basic body 14 comprises a material, especially lightweight metal, such as aluminum or an aluminum alloy, that has the requisite strength for supporting the drive shaft 12.

In a region located between the two bearing points, the drive shaft 12 has at least one portion 16, or cam, that is eccentric to its pivot axis 13; the cam 16 may also be embodied as a multiple lobe cam. The high-pressure pump has at least one, or more, pump elements 18 disposed in the pump housing 10, each with a pump piston 20 that is driven in a reciprocating motion by the eccentric portion 16 or cam of the drive shaft 12, in a direction that is at least approximately radial to the pivot axis 13 of the drive shaft 12. In the region of each pump element 18, one housing part 22 connected to the basic body 14 is provided, which is embodied as a cylinder head. The housing part 22 has a flange 24, resting on an outside of the basic body 14, and an approximately cylindrical extension 26, of lesser diameter than the flange 24, protruding toward the drive shaft 12 through an opening 15 in the basic body 14.

The pump piston 20 is guided tightly displaceably in a cylinder bore 28 that is embodied in the housing part 22, and with its face end remote from the drive shaft 12, the pump piston defines a pump work chamber 30 in the cylinder bore 28. The pump work chamber 30 is disposed in the region of the flange 24 of the housing part 22, and the cylinder bore 28 extends as far as the end, toward the drive shaft 12, of the extension 26 of the housing part 22. Via a fuel delivery conduit 32 extending in the pump housing 10, the pump work chamber 30 has a communication with a fuel delivery means, such as a feed pump. At the mouth of the fuel delivery conduit 32 into the pump work chamber 30, there is an inlet valve 34 which opens into the pump work chamber 30. Via a fuel outflow conduit 36 extending in the pump housing 10, the pump work chamber 30 also has a communication with an outlet, which for instance communicates with a high-pressure reservoir 110. One or preferably more injectors 120 disposed at the cylinders of the engine communicate with the high-pressure reservoir 110, and through them fuel is injected into the cylinders of the engine. At the mouth of the fuel outflow conduit 36 into the pump work chamber 30, there is an outlet valve 38 that opens out of the pump work chamber 30. The housing part 22 comprises a high-strength material, since in the pump work chamber 30, high pressure prevails during the pumping stroke of the pump piston 20. The housing part 22 may for instance comprise steel or gray cast iron.

Between the pump piston 20 and the eccentric portion 16 or cam of the drive shaft 12, a support element may be disposed, in the form of a tappet 40, by way of which the pump piston 20 is braced at least indirectly on the cam 16. The pump piston 20 is coupled to the tappet 40 in a manner not shown in detail in the direction of its longitudinal axis 21. The tappet 34 may be braced directly on the eccentric portion 16 or cam. A ring 42 on which the tappet 40 rests may be rotatably supported on the portion 16 of the drive shaft 12. For each pump element 18, the ring 42 has one flat face 44 on which the tappet 40 rests. In the rotary motion of the drive shaft 12 about its pivot axis 13, the pump piston 20 is driven in a reciprocating motion via the ring 42 and the tappet 40, but the ring 42 does not rotate with the drive shaft 12; it is instead stationary. The tappet 40 is displaceably supported in the base body 14 of the pump housing 10 or on the housing part 22 and absorbs transverse forces that occur upon the conversion of the rotary motion of the drive shaft 12 into the reciprocating motion of the pump piston 20, so that these forces do not act on the pump piston 20. The tappet 40 is engaged by a prestressed restoring spring 48, by which the tappet 40 and the pump piston 20 connected to it are pressed toward the portion 16.

Figure 2:
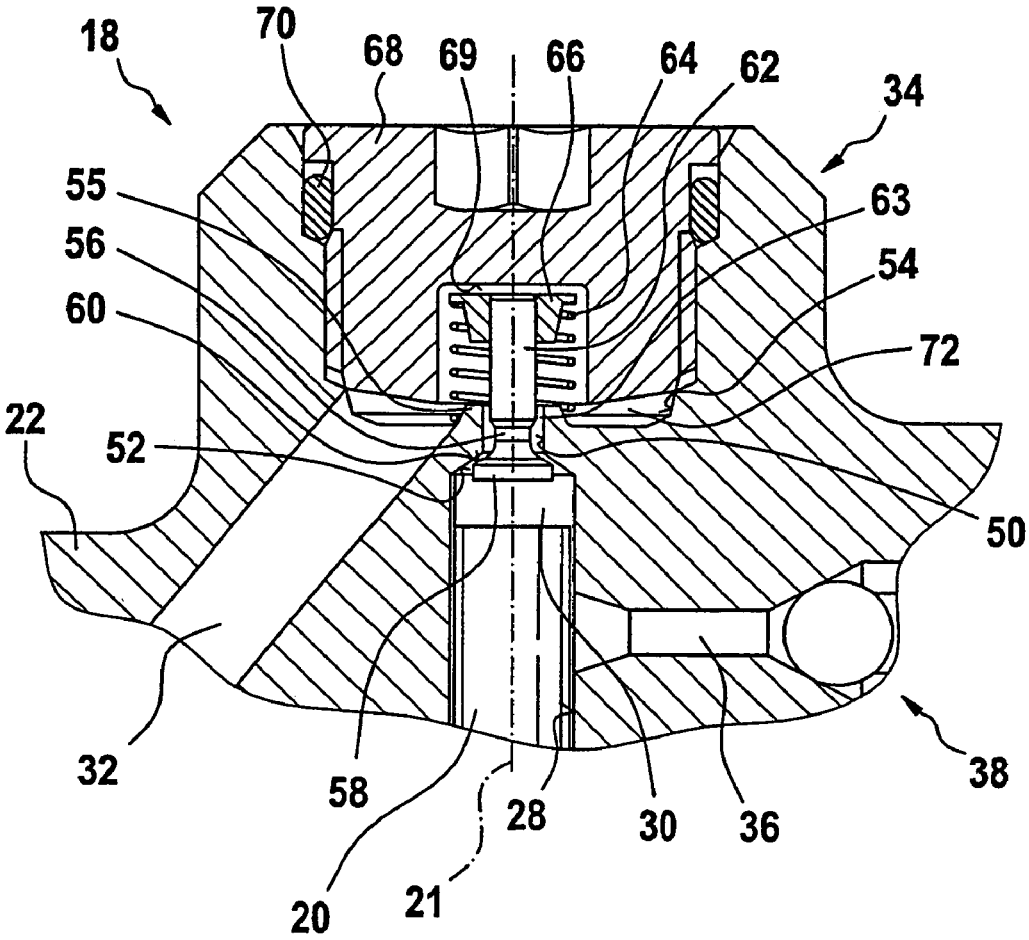
FIG. 2 shows a detail, marked II in FIG. 1, of the high-pressure pump with an inlet valve in an enlarged view in a first exemplary embodiment.

The inlet valve 34 in a first exemplary embodiment will now be described in further detail, referring to FIG. 2. The cylinder bore 28 of the housing part 22 is adjoined, toward the outside of the housing part 22 facing away from the drive shaft 12, by a bore 50, which has a smaller diameter than the cylinder bore 28. At the transition from the cylinder bore 28 to the bore 50, an annular shoulder is formed, on which a valve seat 52 is embodied, which is for instance at least approximately frustoconical. Toward the outside of the housing part 22, the bore 50 is adjoined by a further bore 54 of substantially greater diameter. The inlet valve 34 has a pistonlike valve member 56, which has a head 58 that is disposed in the pump work chamber 30 and thus in the cylinder bore 28. A sealing face 60, which is preferably convex, is embodied on the side of the head 58 of the valve member 56 oriented toward the valve seat 52. The sealing face 60 may be embodied as at least approximately in the form of a portion of a sphere. The head 58 of the valve member 56 is adjoined by a shaft 62 of smaller diameter than the head 58; this shaft protrudes through the bore 50 on into the further bore 54, which forms a region of the housing part 22 that faces away from the pump work chamber 30. A prestressed closing spring 64, embodied as helical compression spring, is disposed in the further bore 54. The closing spring 64 is braced on one end on an annular shoulder 55 on the housing part 22, formed at the transition from the bore 50 to the further bore 54, and on the other on the valve member 56, via a spring plate 66 connected to the shaft 62. By means of the closing spring 64, the valve member 56 is thus urged in the closing direction, and in its closing position the valve member 56 rests with its sealing face 60 on the valve seat 52. The diameter of the shaft 62 of the valve member 56 is less than the diameter of the bore 50, so that between the shaft 62 and the bore 50, a flow cross section remains, in the form of an annular gap 63.

The further bore 54 is tightly closed off toward the outside of the housing part 22 by means of a closure element 68, which is inserted into the bore 54. The closure element 68 may for instance, as shown in FIG. 2, be embodied as a closure screw that has a male thread with which it is screwed into a female thread of the bore 54. Alternatively, the closure element 68 may be joined to the housing part 62 in some other way, for instance being press-fitted into the bore 54 or welded to the housing part 22. Between the closure element 68 and the bore 54, an elastic sealing element 70, for instance in the form of an O-ring, is fastened in place for sealing purposes. The closure element 68, on its side toward the valve member 56, has a recess 69, for instance in the form of a blind bore, in which the shaft 62 of the valve member 56 and the closing spring 64 surrounding the valve member are disposed. The closure element 68 does not extend all the way to the annular shoulder at the transition from the further bore 54 to the bore 50, so that a chamber 72 is defined in the further bore 54 by the closure element 68. The fuel delivery conduit 32 discharges into the chamber 72 and is in communication with the annular gap 63 between the bore 50 and the valve member 56. In the chamber 72, an elevated inflow pressure prevails, which acts on the end face, located inside the valve seat 52, of the head 58 of the valve member 56 and generates a force in the opening direction on the valve member 56. By means of the pressure prevailing in the pump work chamber 30, which acts on the face end, remote from the valve seat 52, of the head 58 of the valve member 56, a force in the closing direction on the valve member 56 is generated.

The bores 50, 54 and the valve seat 52 can be easily manufactured in the housing part 22, since before the housing part 22 and the basic body 14 are put together, the valve seat 52 is accessible for machining purposes from the inside of the cylinder bore 28. Before the housing part 22 and the basic body 14 are put together, the valve member 56 is introduced from the inside of the cylinder bore 28 with its shaft 62 leading, so that this shaft protrudes outward through the bore 50; next, the closing spring 64 and the spring plate 66 are installed, and finally the closure element 68 is inserted.

In the intake stroke of the pump piston 20, in which the pump piston together with the tappet 40 is moved radially inward by the restoring spring 48, a low pressure prevails in the pump work chamber 30, and thus the inlet valve 34 opens in that its valve member 56, with its sealing face 60, lifts from the valve seat 52, since because of the pressure prevailing in the fuel delivery conduit 32, a greater force is generated in the opening direction than the total of the force of the closing spring 64 and of the force generated by the pressure prevailing in the pump work chamber 3-. From the chamber 72, when the inlet valve 34 is open, fuel flows through the annular gap 63 into the pump work chamber 30. At low pressure in the pump work chamber 30 during its filling, the outlet valve 38 is closed. In the pumping stroke of the pump piston 20, in which the pump piston together with the tappet 40 moves radially outward, fuel in the pump work chamber 30 is compressed by the pump piston 20, so that because of the increased pressure in the pump work chamber 30, the inlet valve 34 closes, while fuel at high pressure is pumped through the fuel outflow conduit 36, with the outlet valve 38 open, to the high-pressure reservoir 110. The valve member 56 of the inlet valve 34 is not guided; because of its convex sealing face 60 and the frustoconical valve seat 52, centering is brought about upon the closing motion of the valve member 56, so that the sealing face 60 securely seals off the valve seat 52, and the pump work chamber 30 is disconnected from the fuel delivery conduit 32.

Figure 3:
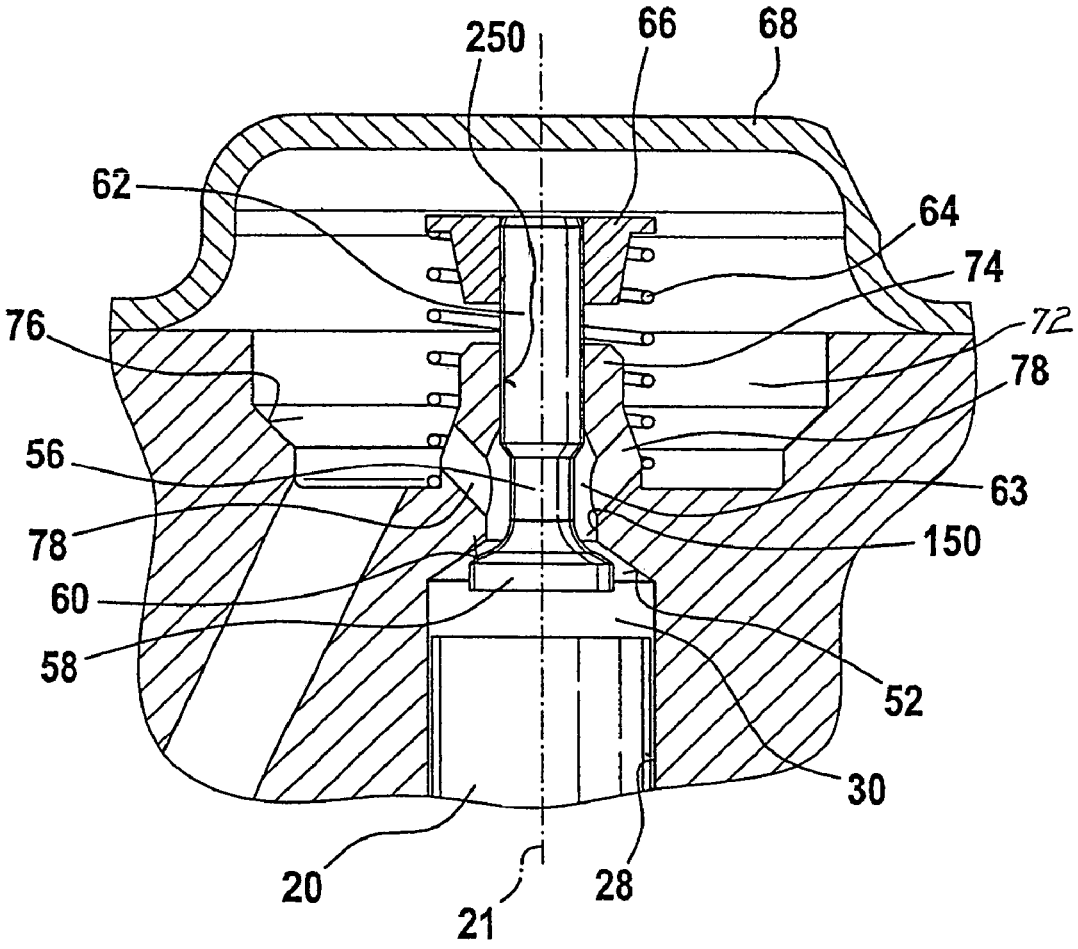
FIG. 3 shows the detail II with the inlet valve in a second exemplary embodiment.

In FIG. 3, the inlet valve 34 is shown in a second exemplary embodiment, which is modified compared to the first exemplary embodiment such that guidance is provided for the valve member 56. The cylinder bore 28 is adjoined, as in the first exemplary embodiment, by the bore 50 of smaller diameter, but here this bore has a first portion 150, discharging into the cylinder bore 28, and a second portion 250, discharging into the further bore 54 and having a smaller diameter than the first portion 150. The valve seat 52, which is embodied for instance at least approximately frustoconically, is disposed at the transition from the cylinder bore 28 to the first bore portion 150. The transition from the first bore portion 150 to the second bore portion 250 may extend at least approximately frustoconically. The bore portions 150, 250 are disposed in an extension 74 of the housing part 22 that protrudes into an indentation 76, formed on the outside of the housing part 22. The first bore portion 150 communicates with the indentation 76 via at least one and preferably more bores 78 in the extension 74 of the housing part 22. The valve member 56 has the head 58, disposed in the pump work chamber 30, that has the sealing face 60, which may for instance be convex and in particular at least approximately in the form of a portion of a sphere, or at least approximately frustoconically. The head 58 is adjoined by the smaller-diameter shaft 62 of the valve member 56; the shaft 62 is guided displaceably with little play in the second bore portion 250, and between the first bore portion 150 and the shaft 62, there is a flow cross section in the form of an annular gap 63. The spring plate 66 is connected to the end region of the shaft 62 of the valve member 56 that protrudes out of the bore portion 250, and the closing spring 64 is fastened between the spring plate and the bottom of the indentation 76.

The indentation 76 is tightly closed off from the outside by means of a closure element 68, and the closure element 68 may be screwed together, pressed on, or welded to the housing part 22. By means of the closure element 68, a chamber 72 is defined in the indentation 76, and the fuel delivery conduit 32 discharges into this chamber; the chamber 72 communicates with the annular gap 63 surrounding the shaft 62 of the valve member 56 via the bores 78. When the inlet valve 34 is open, fuel flows out of the indentation 76 via the bores 78 into the annular gap 63 and from it into the pump work chamber 30. In its opening and closing motion, the valve member 56 is guided with its shaft 62 in the second bore portion 250.

The foregoing relates to a preferred exemplary embodiment of the invention, it being understood that other variants and embodiments thereof are possible within the spirit and scope of the invention, the latter being defined by the appended claims.

The invention claimed is:

1. A high-pressure pump for a fuel injection system of an internal combustion engine, the high-pressure pump having a multi-part pump housing comprising:

a basic body portion adapted to rotatably support a drive shaft and a cylinder head connected to the basic body portion, a cylinder bore formed in the cylinder head, a pump piston guided displaceably in the cylinder bore, one end of the pump piston defining a pump work chamber in the cylinder bore, into which fuel is aspirated via an inlet valve upon an intake stroke of the pump piston and from which fuel is positively displaced upon a pumping stroke of the pump piston, the inlet valve having a pistonlike valve member with a head having a sealing face which cooperates with a valve seat for controlling the communication of the pump work chamber with a fuel inlet, the valve member being urged in a closing direction by a closing spring and by pressure prevailing in the pump work chamber and in an opening direction by pressure prevailing in the fuel inlet, the head of the valve member being disposed in the pump work chamber and protruding from the pump work chamber with a shaft adjoining the head, the closing spring being disposed outside the pump work chamber and engaging the shaft, the valve seat being formed on the cylinder head at a transition from the cylinder bore to an adjoining, smaller-diameter bore formed in the cylinder head;

wherein the valve member, with its shaft, protrudes through the smaller-diameter bore into a further bore in the cylinder head remote from the pump work chamber; and wherein the closing spring is disposed in this further bore in the cylinder head.

2. The high-pressure pump as defined by claim 1, wherein the further bore in the cylinder head in which the closing spring is disposed is tightly closed off from the outside of the cylinder head by means of a closure element; and wherein the fuel inlet discharges into the further bore.

3. The high-pressure pump as defined by claim 2, further comprising a free flow cross section between the shaft of the valve member and the smaller-diameter bore, through which free flow cross section fuel flows out of the region into the pump work chamber in the open state of the valve member.

4. The high-pressure pump as defined by claim 2, wherein the small diameter bore has a first portion discharging into the pump work chamber, between which portion and the shaft of the valve member a flow cross section is uncovered; wherein the smaller-diameter bore has a second portion discharging into the further bore, in which portion the shaft of the valve member is guided displaceably; and that the first portion of the bore communicates with the further bore.

5. The high-pressure pump as defined by claim 1, wherein the sealing face of the valve member is embodied as convex toward the valve seat.

6. The high-pressure pump as defined by claim 2, wherein the sealing face of the valve member is embodied as convex toward the valve seat.

7. The high-pressure pump as defined by claim 3, wherein the sealing face of the valve member is embodied as convex toward the valve seat.

8. The high-pressure pump as defined by claim 4, wherein the sealing face of the valve member is embodied as convex toward the valve seat.

9. The high-pressure pump as defined by claim 1, wherein the sealing face of the valve member is embodied as at least approximately in the form of a portion of a sphere.

10. The high-pressure pump as defined by claim 2, wherein the sealing face of the valve member is embodied as at least approximately in the form of a portion of a sphere.

11. The high-pressure pump as defined by claim 3, wherein the sealing face of the valve member is embodied as at least approximately in the form of a portion of a sphere.

12. The high-pressure pump as defined by claim 4, wherein the sealing face of the valve member is embodied as at least approximately in the form of a portion of a sphere.

* * * * *